US007090379B2

(12) United States Patent
Targetti

(10) Patent No.: US 7,090,379 B2
(45) Date of Patent: Aug. 15, 2006

(54) BI-MATERIAL ANTI-DAZZLE RASTER FOR TUBULAR LIGHT SOURCES

(75) Inventor: Paolo Targetti, Florence (IT)

(73) Assignee: Targetti Sankey S.p.A., Florence (IT)

( * ) Notice: Subject to any disclaimer, the term of this patent is extended or adjusted under 35 U.S.C. 154(b) by 0 days.

(21) Appl. No.: 10/622,913

(22) Filed: Jul. 16, 2003

(65) Prior Publication Data

US 2005/0248947 A1 Nov. 10, 2005

(30) Foreign Application Priority Data

Jul. 19, 2002 (IT) ..... FI20020077 U

(51) Int. Cl.
*F21V 7/22* (2006.01)

(52) U.S. Cl. ..... 362/342; 362/296; 362/354; 362/223

(58) Field of Classification Search ..... 362/291, 362/342, 346, 354, 3, 16, 17, 145, 147, 148, 362/217, 223, 224, 257, 260, 290, 292, 296, 362/297, 304, 305, 311, 317, 341, 347, 351, 362/360, 361; 359/601, 602, 613
See application file for complete search history.

(56) References Cited

U.S. PATENT DOCUMENTS 2,299,276 A * 10/1942 Kirlin ..... 362/342
2,429,141 A * 10/1947 Taylor ..... 362/217
2,537,398 A * 1/1951 Dameral ..... 362/217
4,268,897 A * 5/1981 Schierwagen et al. ..... 362/342
5,528,478 A * 6/1996 Degelmann ..... 362/291
5,944,411 A * 8/1999 Holten et al. ..... 362/342
6,402,345 B1 * 6/2002 Fishman ..... 362/291
6,443,598 B1 * 9/2002 Morgan ..... 362/342
6,582,099 B1 * 6/2003 Bartenbach ..... 362/291

* cited by examiner

*Primary Examiner*—Sandra O'Shea
*Assistant Examiner*—Ismael Negron
(74) *Attorney, Agent, or Firm*—Pollack, P.C.; Grant E. Pollack

(57) ABSTRACT

A bi-material, anti-dazzle raster for tubular light sources includes, for example, at least two side pieces and a plurality of transverse partitions that extend between the pieces. The side pieces are made of a relatively rigid and resistant material and the partitions are grouped into modular units. Each unit includes a selected number of partitions connected to one another by at least two generally parallel connection bars and to the side pieces by a snap fit. The modular units are formed of a selected plastic material using injection molding.

5 Claims, 2 Drawing Sheets

BI-MATERIAL ANTI-DAZZLE RASTER FOR TUBULAR LIGHT SOURCES

FIELD OF THE INVENTION

The present invention relates generally to lighting fixtures and, more particularly, to assemblies for producing enhanced lighting effects.

BACKGROUND OF THE INVENTION

Conventional anti-dazzle rasters for tubular light sources, e.g., fluorescent bulbs, are typically formed by two side pieces, e.g., constructed of aluminum sheeting, generally of an arcuate profile, and by a plurality of transverse partitions mounted thereto via snap fit engagement with notches in the side pieces. The side pieces are also generally parallel to and diverge from opposite locations relative to the median plane in which the light source is situated. Such partitions often have a V-shaped section with transverse flaps bent back towards the interior thereof for added stiffness. Because these partitions must be mounted on the side pieces, one at a time, the anti-dazzle raster which results has been found relatively expensive.

A generally less expensive solution would be to manufacture anti-dazzle rasters from a plastic material using injection molding. While, in this manner, the side pieces and partitions may be formed as a single piece, the length of a raster produced in this fashion is necessarily less than that of a normal raster in aluminum, for reasons associated with the molding operation. In addition, rasters of this type are considered less appealing from an aesthetic point of view, since several modules must be combined to cover the length of such lighting fixtures. In particular, the lengths of these fixtures typically vary from a minimum of about 600 mm to a maximum of about 1800 mm, whereas rasters constructed of plastic do not generally exceed approximately 600 mm in length. Furthermore, the individual modules must be separately attached to the body of the lamp. As a result, the structure is more complex and lamp replacement is more difficult and laborious.

OBJECTS AND SUMMARY OF THE INVENTION

Accordingly, it is an object of the present invention to provide a polymeric anti-dazzle raster for tubular light sources that not only avoids the assembly problems of conventional metal rasters, but also has the requisite mechanical strength but without the aesthetic drawbacks of prior plastic raster arrangements.

This and other objects are attained by the present invention, in which side pieces are made of a relatively rigid and resistant material and the partitions are grouped into modular units, each unit being formed by a selected number of partitions connected to each other by a plurality of generally parallel connection pieces and being attached, by snap fit engagement, to the side pieces, the modular unit preferably being constructed of a polymeric material or the like by injection molding.

BRIEF DESCRIPTION OF THE DRAWINGS

The present invention will now be described with reference to the description set forth below of specific, illustrative embodiments thereof, made with reference to the following drawings, in which.

The same numerals are used throughout the drawing figures to designate similar elements. Still other objects and advantages of the present invention will become apparent from the following description of the preferred embodiments.

DETAILED DESCRIPTION OF THE PREFERRED EMBODIMENTS

Figure 1:
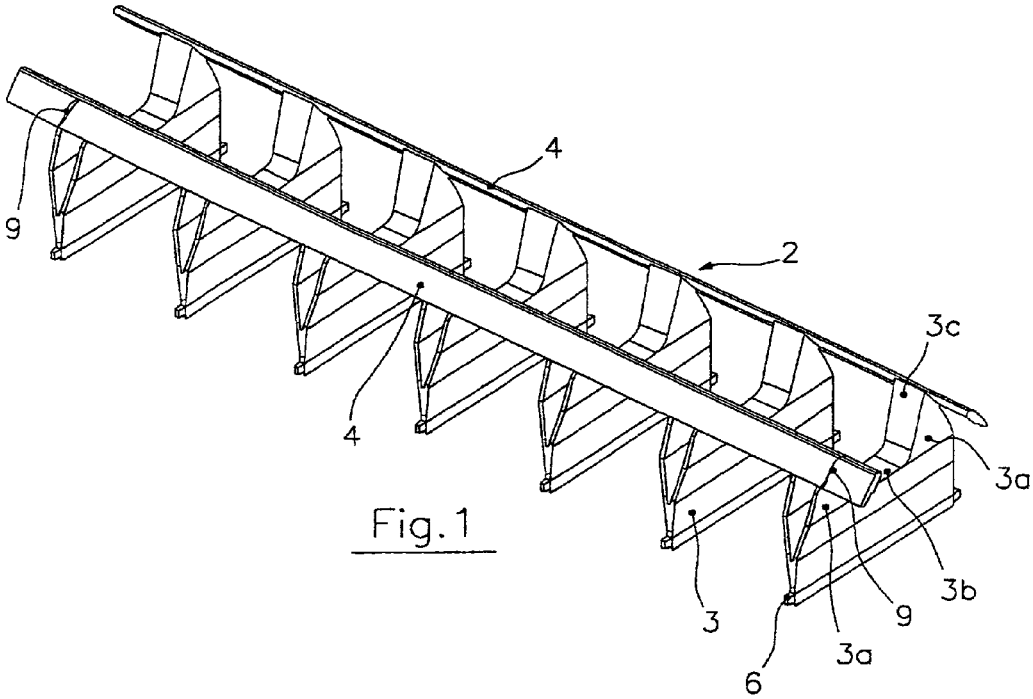
FIG. 1 is a perspective view of a partition module for an anti-dazzle raster, according to one aspect of the present invention.
Figure 2:
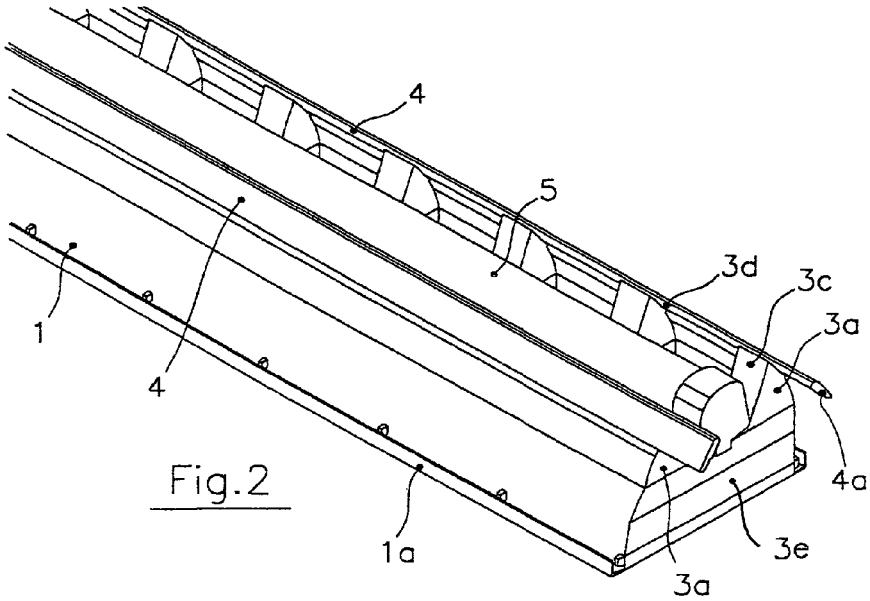
FIG. 2 is a perspective view of a portion of a neon lamp for mounting an anti-dazzle raster in accordance with the present invention.
Figure 3:
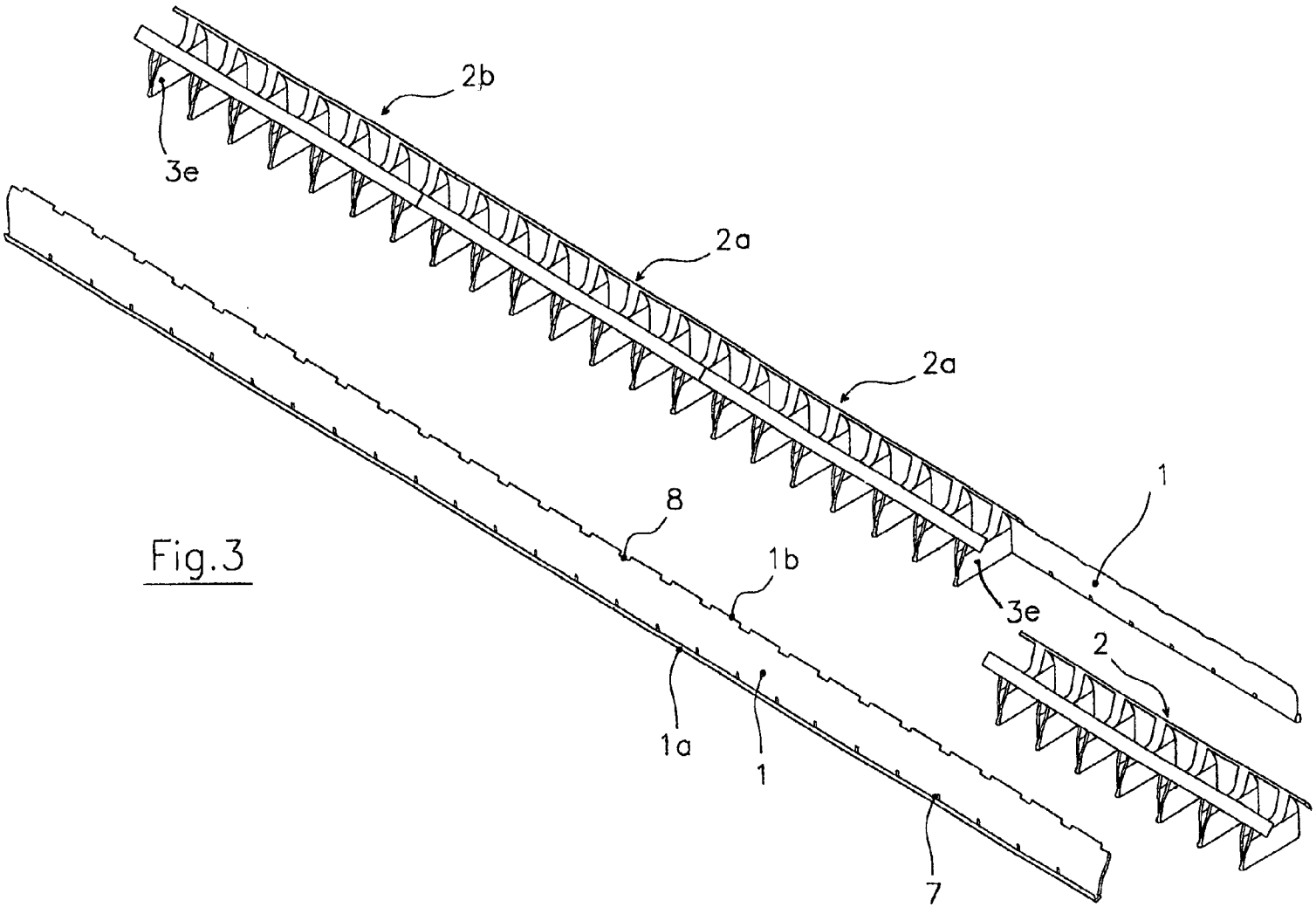
FIG. 3 is an exploded perspective view of an anti-dazzle raster in accordance with the present invention.

Referring now to the drawings and more particularly to FIGS. 1–3, there is shown generally a specific, illustrative, anti-dazzle raster, according to one aspect of the present invention. In one embodiment, the raster preferably comprises two side pieces 1 constructed of a suitable material, e.g., aluminum sheeting. A modular element 2 is constructed of a selected number of parallel transverse partitions 3, set a relatively uniform distance apart, and connected to one another by two bars 4. Partitions 3 and bars 4 are preferably formed into a single piece constructed of a selected plastic material, such as polycarbonate, by injection molding or the like.

Desirably, each transverse partition has a generally box-shaped configuration and a substantially V-shaped section with two symmetrical shoulders 3*a* that extend from its upper edge 3*b*. Opposite internal faces 3*c* of each pair of shoulders 3*a*, together with upper edge 3*b* of the respective partition, delimit a channel-like portion for accommodating fluorescent lamp 5, shown in FIG. 2. Bars 4, on the other hand, are attached to outside faces 3*d* of shoulders 3*a* of each partition. As also shown, the outside faces are inclined such that the two bars lie in two planes, the intersection of which is generally parallel to the axis of the fluorescent lamp.

Side pieces 1 preferably have a conventional arcuate profile that matches generally the lateral profile of partitions 3. Desirably, a projecting tooth is provided on both lateral edges of each partition, in proximity to its lower end, that, during assembly, engages by a snap fit with a corresponding seating 7 arranged along a longitudinal edge 1*a* of each of the two side pieces 1. Once modular elements 2 and side pieces 1 have been assembled and attached to one another, an opposing longitudinal edge 1*b* of each of the side pieces engages a longitudinal groove 4*a* beneath bar 4 on the face not in view of the bar. Notches 8 are provided along edge 1*b* of the side pieces in positions corresponding to each partition 3, the respective widths of the notches being equal to those of shoulders 3*a* so as to permit the side pieces to engaged beneath the bars 4.

To enable several modular elements 2 to be coupled to one another as modules 2*a* of a raster and, thereby, achieve an anti-dazzle raster of a desired length, while maintaining the same distance between partitions, also at the joint between two adjacent modules, bars 4 project beyond terminal partitions 3*e* of each module by a length equal to half the distance between two partitions. Advantageously, at the beginning of the projecting part of each bar 4, a tear-off line, indicated by reference number 9 in FIG. 1, may be provided to facilitate removal of the projecting part of the bar from terminal modules 2*b* of the raster. This, in turn, permits application of a closure plug or some other accessory with equivalent functions. Thereby, it is also possible to use a single modular element both as an intermediate module of the anti-dazzle raster and as a terminal module after the projecting ends of the bars have been removed.

Because of the solution provided by the present invention, assembly operations are significantly simplified without degradation of the aesthetics of the finished raster product. In fact, during assembly, the partitions need not be mounted one at a time, but rather can be mounted in groups, while the external appearance of the raster will be that of a continuous surface, because each of its side pieces is formed as a single piece. Moreover, once it is mounted, the raster constitutes a single body and is, therefore, easy to remove when, for example, the lamp has to be replaced.

Various modifications and alterations to the invention may be appreciated based on a review of this disclosure. These changes and additions are intended to be within the scope and spirit of the invention as defined by the following claims.

The invention claimed is:

1. An anti-dazzle raster for tubular light sources, the raster comprising a plurality of side pieces made of a generally rigid metallic material and a plurality of transverse partitions extending between the side pieces, the partitions being grouped into modular units, wherein each unit includes a selected number of partitions connected to one another by a plurality of relatively parallel connection bars, and joined by snap fit engagement with the side pieces, the modular units being injection molded of a polymeric material.

2. The raster set forth in claim 1, wherein each partition has a substantially V-shaped section and a plurality of relatively symmetrical shoulders that extend from an upper edge of the partition, the connecting bars being affixed to outside faces of the shoulders.

3. The raster set forth in claim 1, wherein teeth extend from the partitions in a generally lateral direction suitable for snap fit engagement with corresponding seatings of the side pieces.

4. An anti-dazzle raster for tubular light sources, the raster comprising a plurality of side pieces made of a generally rigid material and a plurality of transverse partitions extending between the side pieces, the partitions being grouped into modular units, wherein each unit includes a selected number of partitions connected to one another by a plurality of relatively parallel connection bars, and joined by snap fit engagement with the side pieces, the modular units being injection molded of a polymeric material, wherein the connection bars of each modular unit of partitions project beyond the partition ends a distance equal to about one-half the distance between two adjacent partitions.

5. An anti-dazzle raster for tubular light sources, the raster comprising a plurality of side pieces made of a generally rigid material and a plurality of transverse partitions extending between the side pieces, the partitions being grouped into modular units, wherein each unit includes a selected number of partitions connected to one another by a plurality of relatively parallel connection bars, and joined by snap fit engagement with the side pieces, the modular units being injection molded of a polymeric material, wherein the connection bars of each modular unit of partitions project beyond the partition ends a distance equal to about one-half the distance between two adjacent partitions, and a tear-off line is provided at the root of the connection bars' projection portion in order to facilitate removal of the portion.

* * * * *